United States Patent [19]

Miyazaki et al.

[11] 4,204,393

[45] May 27, 1980

[54] DUST REMOVING MECHANISM IN OPEN-END SPINNING FRAME

[75] Inventors: Tsutomu Miyazaki; Masao Shiraki, both of Kariya; Kinpei Mitsuya, Aichi, all of Japan

[73] Assignee: Kabushiki Kaisha Toyoda Jidoshokki Seisakucho, Aichi, Japan

[21] Appl. No.: 971,499

[22] Filed: Dec. 20, 1978

[30] Foreign Application Priority Data

Dec. 27, 1977 [JP] Japan ..... 52-159734
Mar. 9, 1978 [JP] Japan ..... 53-027080

[51] Int. Cl.[2] ..... D01H 11/00
[52] U.S. Cl. ..... 57/301; 57/304
[58] Field of Search ..... 57/58.89–58.95, 57/300, 301, 302, 304

[56] References Cited

U.S. PATENT DOCUMENTS

| | | | |
|---|---|---|---|
| 3,792,575 | 2/1974 | Doudlebsky et al. | 57/301 |
| 3,797,218 | 3/1974 | Landwehrkamp et al. | 57/301 X |
| 3,826,071 | 7/1974 | Grau | 57/301 |
| 3,884,027 | 5/1975 | Schumann et al. | 57/301 |
| 3,959,961 | 6/1976 | Stahlecker | 57/301 |
| 3,986,327 | 10/1976 | Kobayashi | 57/301 |
| 4,009,562 | 3/1977 | Stalder | 57/301 |
| 4,036,002 | 7/1977 | Kobayashi | 57/301 X |
| 4,142,356 | 3/1979 | Husges et al. | 57/301 |

*Primary Examiner*—John Petrakes
*Attorney, Agent, or Firm*—Burgess, Ryan and Wayne

[57] ABSTRACT

A dust removing mechanism is applied to each unit of an open-end spinning machine. In each spinning unit provided with an opening roller and a spinning rotor for creating a yarn from fibers supplied from the opening roller, a casing partly surrounds the opening roller and a dust removing opening is formed in the casing. In such mechanism, a dust removing zone is formed so that it communicates with the dust removing opening and the dust removing zone is divided into a dust separating zone and a dust discharging zone. An air-takein opening is provided so as to create an auxiliary air stream, by which the separation of dust from the useful fibers can be effectively carried out.

13 Claims, 15 Drawing Figures

DUST REMOVING MECHANISM IN OPEN-END SPINNING FRAME

BACKGROUND OF THE INVENTION

1. Field of the Invention

The present invention relates to a dust removing machanism in an open-end spinning frame. More particularly, the invention relates to an improvement in the dust removing mechanism of the type where dust is caused by a centrifugal action to be removed through a dust removing opening formed on a casing of an opening roller while fibers are being opened and delivered by the opening roller.

2. Description of the Prior Art

When impurities and foreign matter such as dust, neps, leaf pieces, seed pieces and chemical adhering substances (inclusively referred to as "dust" hereinafter) are contained in material fibers, there is a tendency to collect the dust in a twisting zone and the spinning operation for forming yarn from the fibers becomes unstable, resulting in a reduction of the yarn quality.

Accordingly, the method, in which a dust removing opening is formed at a part of a fiber-opening zone, wherein an opening roller is disposed upstream of the twisting zone, and dust is caused to fly off through this dust removing opening by a centrifugal force, has been adopted in various modes. However, satisfactory results can not be obtained according to this known method.

Since the dust removal from the dust removing opening depends on centrifugal force thereof, fibers also are caused to fly off by the centrifugal force thereof. As means for preventing the flying-off of fibers, there has been proposed a method in which an auxiliary air stream is applied to flow toward the dust removing opening so that the stream is introduced into the opening. In this method, dust having a large mass is allowed to fly off from the dust-separating zone against the carrying force of this auxiliary air stream, but fibers having a smaller mass are caught by this air stream and are not allowed to fly off from the above-mentioned zone, and are delivered to the twisting zone by the opening roller. In this method, the dust-removing effect is remarkably influenced by the intensity of the auxiliary air stream and the direction of flow thereof, and therefore, delicate adjustment of the air stream is required at the dust-removing opening.

Further, there has been proposed a method in which, in order promptly to discharge dust flying off from the dust-separating zone which is connected to the dust-removing opening while preventing this dust from staying in the vicinity of the dust-removing opening, a sucking air stream flowing in a dust-discharging zone adjacent to the dust-separating zone is introduced into the dust-separating zone. In this method, adjustment of the relation between the discharge sucking air stream and the auxiliary air stream in the separating zone is very complex and difficult. More specifically, in order to promptly discharge dust flying off from the dust-removing opening and separating zone, it is necessary to produce the above-mentioned discharge sucking air stream at a position close to the separating zone and it is also necessary to increase the intensity of this sucking air stream. However, if the intensity of the sucking air stream is enhanced, the sucking air stream influences the separating zone and disturbs the smooth flowing of the auxiliary air stream, and also, causes fibers to be discharged. If the intensity of the sucking air stream is reduced to prevent fiber loss, the influence in the separating zone is lost causing adhesion and deposition of dust and fine fibers to the walls of the separating zone and dust-discharging zone. When dust stays on the walls, leaf pieces and the like act as nuclei and fine fibers adhere to and gather around these nuclei, and dust is gradually accumulated on the walls. When the degree of accumulation of dust on the walls exceeds a certain limit, it is scattered in the form of large masses by the action of the air streams and these dust masses are influenced by the auxiliary air stream directed toward the dust removing opening. As a result, these dust masses are sucked into the dust removing opening. This phenomenon occurs when adjustment of the air streams is not appropriately carried out.

SUMMARY OF THE INVENTION

In the dust removing method for an open-end spinning frame, in which an auxiliary air stream for catching fibers from the dust removing opening and a sucking air stream for discharging dust are utilized, the auxiliary air stream should be applied in such way that the dust is removed from the dust removing opening, but the fibers are prevented from being removed through the dust removing opening. The sucking air stream should have little influence on the dust-separating zone and be capable of flowing strongly in the dust-discharging zone.

The present invention is directed toward realizing the above-mentioned conditions in the dust-removing method. More specifically, it is a primary object of the present invention to provide a dust removing mechanism for an open-end spinning frame, in which, in connection with an auxiliary air stream for blocking fibers, which flows into a dust removing opening formed on a casing surrounding an opening roller and a dust-separating zone which is connected to the above-mentioned dust removing opening, a flow condition is specified so that the flying-off of dust through the dust removing opening is allowed but the flying-off of fibers is prevented, and the auxiliary air stream in the dust-separating zone is separated as much as possible from a sucking air stream in a dust-discharging zone connected to the separating zone.

Another object of the present invention is to provide a dust removing mechanism for an open-end spinning frame, in which a separating plate is disposed in such a manner as to define a dust-separating zone communicated with air outside the apparatus to generate an auxiliary air stream directed to a dust removing opening, a dust-discharging zone and a dust discharge-promoting zone for generating a linear sucking air stream, which includes a suction opening and a confronting air intake opening, a passage communicating the dust-separating zone and dust-discharging zone with the dust-discharge-promoting zone is formed as a transfer passage for flying dust downstream of the dust removing opening with respect to the rotation direction of an opening roller, and the walls of the dust-separating zone and dust-discharging zone are inclined on the downstream side so that dust flying off through the dust removing opening bounces back to the communicating passage and is finally introduced into the dust-discharging zone. In this dust removing apparatus, the separating plate defining the dust-separating zone, the dust-discharging zone and the dust discharge-promoting zone regulates the flow line of the sucking air stream and prevents any serious influence of the sucking air stream on the dust removing opening, and dust flying off through the dust removing opening is caused to bounce off the inclined walls due to the kinetic energy of the flying dust and is positively discharged from the suction opening into the dust-collecting zone, while being carried by the sucking air stream in the dust discharge-promoting zone. Accordingly, the most characteristic feature of this dust removing mechanism is that the dust flying off through the dust removing opening is prevented from staying in the dust-separating zone and dust-discharging zone and it is positively discharged from the suction opening into the dust-collecting zone by the sucking air stream in the dust discharge-promoting zone.

BRIEF DESCRIPTION OF THE DRAWINGS

FIGS. 9, 10, 11 and 12 are views illustrating a second embodiment of the mechanism of the present invention, in which FIG. 9 is a plan view illustrating the entire structure of an open-end spinning unit to which the mechanism of this embodiment is attached, where main parts are shown in section, FIG. 10 is a perspective view, FIG. 11 is a sectional side view and FIG. 12 is a sectional plan view.

FIGS. 13 and 14 are views illustrating a third embodiment of the mechanism of the present invention, in which FIG. 13 is a sectional side view and FIG. 14 is a sectional plan view.

DETAILED DESCRIPTION OF THE PREFERRED EMBODIMENT

The present invention will now be described in detail by reference to embodiments illustrated in the accompanying drawings.

Figure 1:
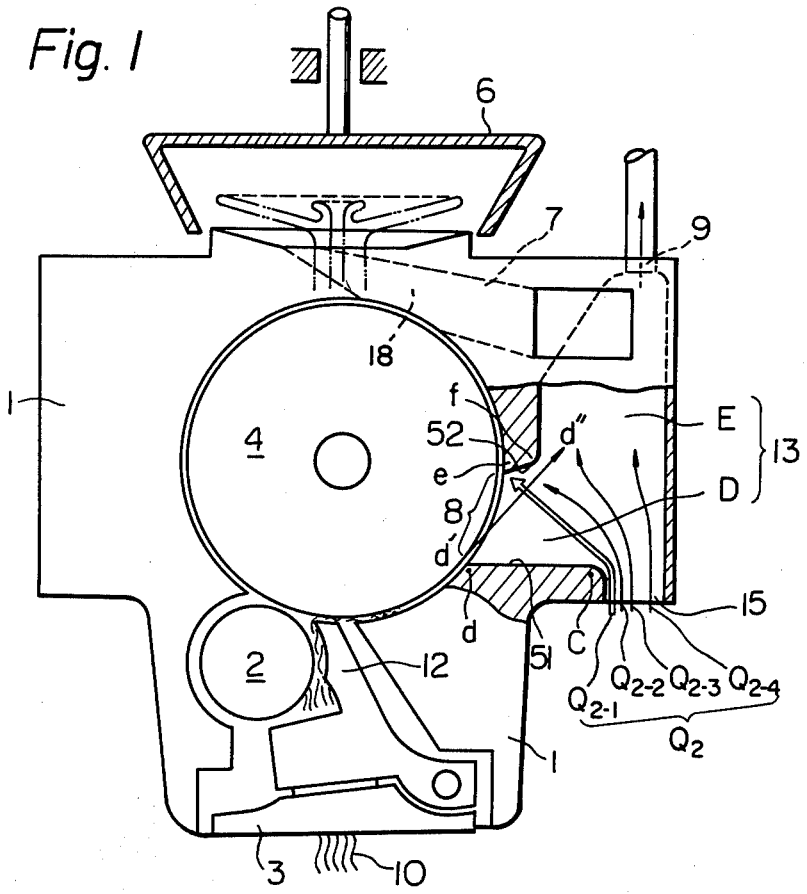
FIG. 1 is a plan view illustrating the entire structure of an open-end spinning unit to which the mechanism of the present invention is attached, in which main parts are shown in section.

In an embodiment of the spinning unit illustrated in FIG. 1, a material sliver 10 fed through a collector 3 is gradually delivered into an adjacent opening zone, including an opening roller 4, while being gripped between a presser 12 and a feed roller 2. The opening roller 4 is rotated at a high speed and it performs a fiber-opening action and a fiber-delivering action between an opening member attached to the peripheral surface thereof and the wall of a casing 1 surrounding the opening roller 4. Fibers delivered in a state of adhering to the peripheral surface of the opening roller 4 are peeled off by the difference of flow speeds of air streams in a fiber-peeling zone where the opening roller 4 becomes contiguous with a fiber-peeling channel 7 having one end communicated with air outside the apparatus and the other end directed to the interior of a rotary spinning chamber 6 constituting a twisting zone, and the peeled fibers are delivered through the channel 7 into the rotary spinning chamber 6.

In the spinning unit having the above-mentioned structure, the mechanism of the present invention is disposed, the basic structure of which comprises a dust-removing opening 8 formed on the casing 1 between the opening zone and fiber-peeling zone, a dust-separating zone D communicated with said dust removing opening 8, and a dust-discharging zone E including an outer air intake opening 15 for an auxiliary air stream Q2 which prevents flying-off of useful fibers and means for generating a sucking air stream for the discharge of dust, namely a suction opening 9. In the dust removing method utilizing the dust-separating zone D, which includes the dust removing opening 8, and the dust-discharging zone E, which includes means for generating the sucking air stream for the discharge of dust, it is necessary to reduce to a lowest level the quantity of fibers contained in the flying material which flys off from the dust removing opening 8. For this purpose, it is necessary to maintain an optimum flow condition for the auxiliary air stream Q2. Namely, an optimum flow relation should be established between this auxiliary air stream Q2 and a dust-separating air stream.

The inventors of the present invention noted that the locus of the flying material from the dust removing opening 8 does not substantially change and that this locus is different for the fibers and dust. Based on this phenomenon, in the present invention, the flow direction of the auxiliary air stream Q2 is specified so as to satisfy the above mentioned optimum flow relation requirement.

Fibers delivered to the opening zone by the opening roller 4 are exposed to a large centrifugal force at the dust removing opening 8 where the control action of the inner wall is released, because the roller 4 is rotated at a high speed. Accordingly, dust having a larger mass than the fibers, and relatively short fibers which do not receive the catching action of the opening roller 4 and, hence, rise to the cylindrical surface portion of the roller 4, are likely to fly off from the dust removing opening 8. Further, the dust flies in the tangential direction d'-d" at the peripheral position of the opening roller 4 facing the inner end d of a wall 51, which is located on the upstream side with respect to the rotation direction of the opening roller 4 of the opening 8. The separating zone D is defined by the wall 51 and a wall 52. Of course, the above-mentioned rising action is caused also in high quality fibers contained in the supplied material at the dust removing opening 8, but the flying of such high quality fibers is blocked by the catching force of the roller 4 and by inflow of the auxiliary air stream Q2.

The fly-out forces of dust and fibers flying substantially in the tangential direction d'-d" are expressed as follows:

$$m_1 dV_1/dt \text{ (for dust), and } m_2 dV_2/dt \text{ (for fibers)}$$

in which $m_1$ stands for the mass of dust and $V_1$ stands for the fly-out speed of dust, and $m_2$ stands for the mass of fibers and $V_2$ stands for the fly-out speed of fibers. Accordingly, in general, dust having a larger mass than fibers is more likely to overcome the auxiliary air stream Q2 and pass through the separating zone D.

However, in the method in which only this difference of the mass is utilized for causing dust to fly off while preventing flying off fibers, careful and delicate adjustment of the intensity of the auxiliary air stream Q2 is required. In this regard, if spinning conditions, such as the kind of material fibers, the air discharge rate in the rotary spinning chamber 6 and the rotation number of the opening roller 4, are changed, the intensity of the auxiliary air stream Q2 should be adjusted again. If this adjustment is insufficient, such undesirable phenomena as preventing the flying off dust and allowance of the flying off of useful fibers take place.

Figure 2:
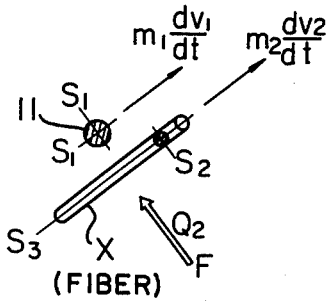
FIG. 2 is a schematic diagram illustrating the relation between the flying force of a flying material and the air-resisting force.

Referring to FIG. 2, the inventors noted that the locus of flying dust 11 and flying fibers substantially coincides to a direction along the tangential line d'-d'', and they proceeded to direct their attention to improvements based on the concept that between the dust and air, there is present a difference of the air-resisting force against an air stream flowing in a certain direction. Again referring to FIG. 2, there is no substantial difference between a sectional area S1 of pieces of dust 11 and a sectional area S2 of individual fibers in a direction intersectlng the flying direction (coincident with the tangential line d'-d'') at a right angle. In connection with the sectional area along the flying direction, however, pieces of dust 11 having a substantially spherical shape have the same sectional area as S1, whereas the sectional area S3 of individual fibers in the longitudinal direction thereof is much larger than S1 or S2 because the fibers have a length. Accordingly, the air-resisting forces of the dust 11 and fibers in a direction parallel to the flying direction are not very different from each other, because the sectional areas S1 and S2 are approximately the same, and therefore, there is no substantial difference in the flying movement between the dust 11 and fibers. However, it will readily be understood that with respect to the air-resisting force F in a direction intersecting the flying direction at a right angle, there is a great difference between the dust 11 and fibers. Namely, the air-resisting force F is represented by the formula:

$$F=\tfrac{1}{2}\rho V^2 Scf$$

wherein $\rho$ stands for the density of air, V stands for the velocity of air stream, S designates the sectional area in a direction intersecting the flow line direction of air at a right angle, and cf is a coefficient. Ordinarily, since the sectional area S3 of the individual fibers is much larger than the sectional area S1 of the pieces dust 11, the relations of the following formulae are established.

$$F1=\tfrac{1}{2}cf\rho V^2 S1<m_1 dV_1/dt \text{ (for dust)}$$

and $$F3=\tfrac{1}{2}cf\rho V^2 S3>m_2 dV_2/dt \text{ (for fibers)}$$

Accordingly, the dust 11 is capable of continuously flying, while the flying-off of the fibers is prevented in the air flow line direction.

Referring to FIG. 1, in the present invention, in order to embody the above mentioned concept, the auxiliary air stream Q2 is caused to act in a direction intersecting substantially at a right angle the flying direction of the dust 11 and fibers along the tangential line d'-d''. More specifically, in the apparatus of the present invention, an arrangement is made so that a line c-e, connecting the outer end c of the upstream wall 51 to the inner end e of the downstream wall 52, intersects substantially at a right angle the tangential line d'-d'' at the peripheral position of the opening roller 4 corresponding to the inner end d of the upstream wall 51 of the dust-separating zone D. On one hand, there are present dust 11 and fibers which are about to fly-out from the dust removing opening 8 in the tangential direction. On the other hand, the sucking action of the rotary spinning chamber 6 influences the area close to the downstream side of the opening 8, and consequently, an auxilary air stream Q2 is created which is introduced to the downstream side of the dust removing opening 8 from the outer air intake opening 15, formed externally of the outer end c of the wall 51. Since it has been found that the main component Q2-1 of this air stream Q2 flows along the shortest distance between the intake opening 15 and the downstream side of the opening 8, the flowing locus of the main stream component Q2-1 is in agreement with the line c-e connecting the outer end c of the wall 51 to the inner end e of the wall 52.

Figure 7:
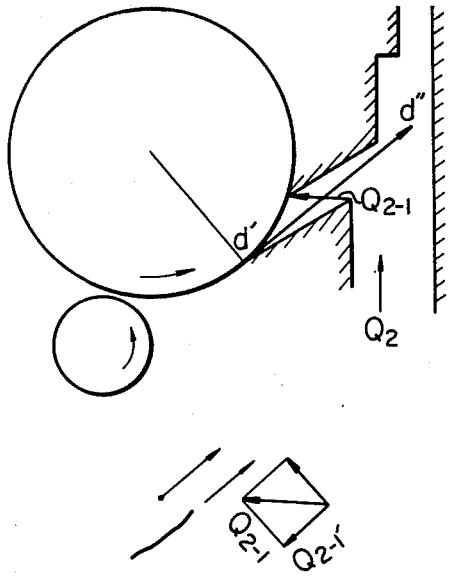
FIGS. 7 and 8 are views illustrating the arrangement in the conventional apparatus.
Figure 8:
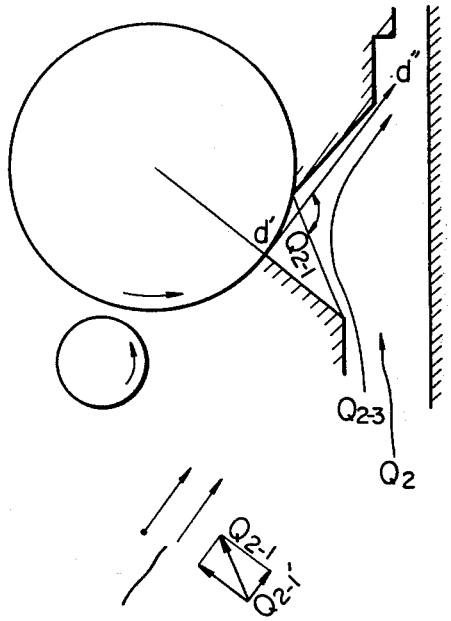

In the conventional dust removing mechanism utilizing the auxiliary air stream Q2, since the flow-in angle of the air stream Q2 is not taken into consideration, the main stream component Q2-1 often intersects the flying locus d'-d'' at an acute angle or obtuse angle as illustrated in FIG. 7 or 8. In FIG. 7, the component Q-2-1' acts in a direction opposite to the direction of the flying material, and in this case, since separation of dust from fibers depends on the difference of the mass, separation of dust is very difficult. In FIG. 8, the component Q2-1' acts in the same direction as the flying direction, and therefore, even the flying of fibers is promoted.

Figure 3:
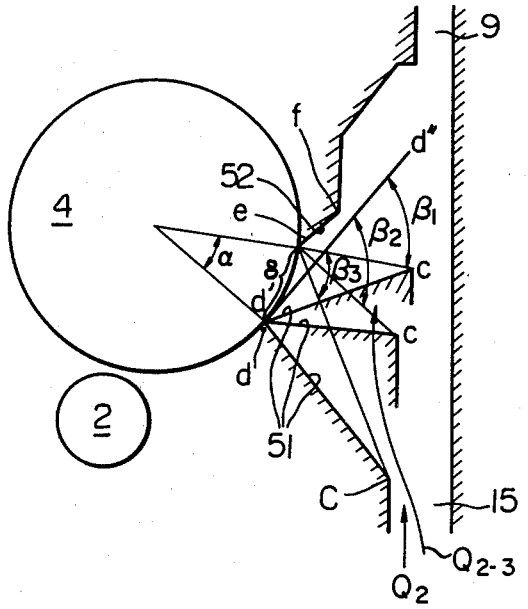
FIG. 3 is a schematic diagram illustrating various modes of an experiment carried out with regard to the flying direction of a flying material and the flow direction of an auxiliary air stream.
Figure 4:
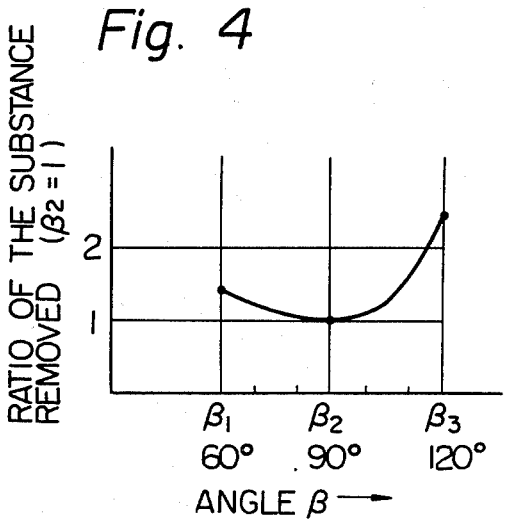
FIG. 4 is a graph showing the dust discharge ratios obtained in the experiment conducted with regard to FIG. 3.
Figure 5:
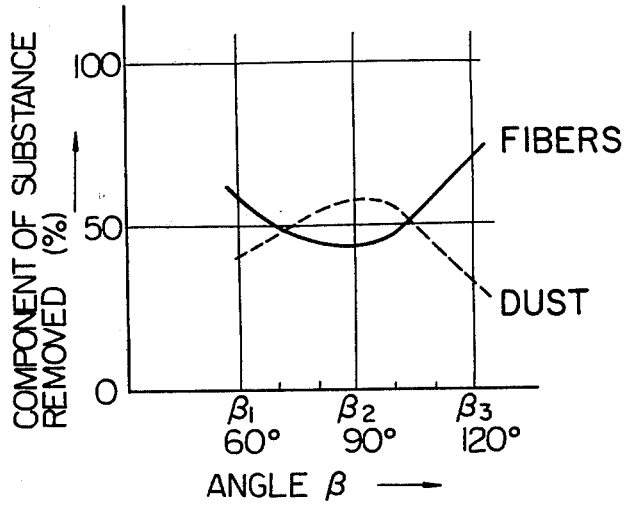
FIG. 5 is a graph showing the discharge ratios of the dust and fibers, obtained in the experiment conducted with regard to FIG. 3.

In the present invention, since the main stream component of the auxiliary air stream Q2 is caused to act in a direction intersecting the direction of the flying material at a right angle, the flying material is not influenced by any component of the force, and even if the intensity of the air stream Q2 is not delicately adjusted, removal of dust and separation of dust from fibers can be performed relatively effectively. Experiments were conducted so as to confirm the effects attained by this arrangement in the present invention. More specifically, the size of the opening 8 was fixed at an open angle ($\alpha$) from the center of the opening roller 4 as illustrated in FIG. 3, and experiments were conducted while changing an intersecting angle ($\beta$) between the flying direction d'-d'' of the flying material and the line c-e connecting the outer end c of the wall 51 to the inner end e of the wall 52, and the amount of the flying material and the composition of the flying material were analyzed. The results obtained are shown in FIGS. 4 and 5. As will be apparent from FIGS. 4 and 5, in case of $\beta 2=90°$, the ratio of the removed substance is lower than in case of $\beta 1=60°$ or $\beta 3=120°$, and the content of dust in the removed substance is highest and the fiber content is lowest in case of $\beta 2=90°$. Thus, it has been confirmed that best results can be obtained in case of $\beta 2=90°$. By these experiments, it has been proven that the case of $\beta 2=90°$ claimed in the present invention attains the highest effects in the dust removing apparatus according to the above-mentioned theory. It has also been confirmed by experiments that intersecting angles $\beta$ in the range of $90°\pm 10°$ provide good results comparable to results attainable when the intersecting angle $\beta$ is 90°.

The fact that a very high ratio of removed substance is attained in case of $\beta 3=120°$ indicates that the main stream Q2-1 of the auxiliary air stream Q2 includes a flying-promoting component Q2-1' (see FIG. 8) as pointed out hereinbefore. When an experiment was conducted at an intersecting angle of $\beta 3=120°$ using the construction as illustrated in FIG. 8, it was found that in this experiment there was obtained a removal ratio higher than the removal ratio attained at the intersecting angle of $\beta 3=120°$ using the construction indicated in FIG. 3. As a result of investigations made to clarify the cause of this phenomenon, it was found that the air stream flowing in from the outer air intake opening 15 includes not only the main stream Q2-1 but also an air stream Q2-2 which can flow in the separating zone D as the auxiliary air stream, an air stream Q2-3 which comes close to the separating zone D but finally flows in the discharging zone E and an air stream Q2-4 which flows substantially linearly to the suction opening 9 to discharge the dust 11 (see FIG. 1). It has been found that among these air streams, the air stream Q2-3 is a factor distinguishing the present invention (see FIG. 3) over the conventional apparatus (see FIG. 8) with respect to the ratio of removed substance. In the apparatus of the type comprising an outer air intake opening 15 for the auxiliary air stream Q2 and a dust-discharging suction opening 9 on the side confronting the intake opening 15, the flowing locus of the above-mentioned air stream Q2-3 is determined by the positions of the outer end c of the upstream wall 51 and the outer end f of the downstream wall 52. In the conventional apparatus (see FIG. 8), since the extension of the line connecting the outer end c to the outer end f is directed to the dust-discharging zone E, the air stream Q2-3 first intrudes deeply into the separating zone D and then flows out therefrom. Accordingly, this stream Q2-3 disturbs the main stream Q2-1 and promotes the flying-out of the flying material. In case of $\beta 3=120°$ in FIG. 3, the direction of the extension of the line connecting the outer end c to the outer end f is directed away from the discharging zone E. Accordingly, the degree of intrusion of the air stream Q2-3 into the separating zone is very small, and the action of promoting the flying-out of the flying material is very much reduced as compared with the flying-out promoting action in the conventional apparatus.

Figure 6:
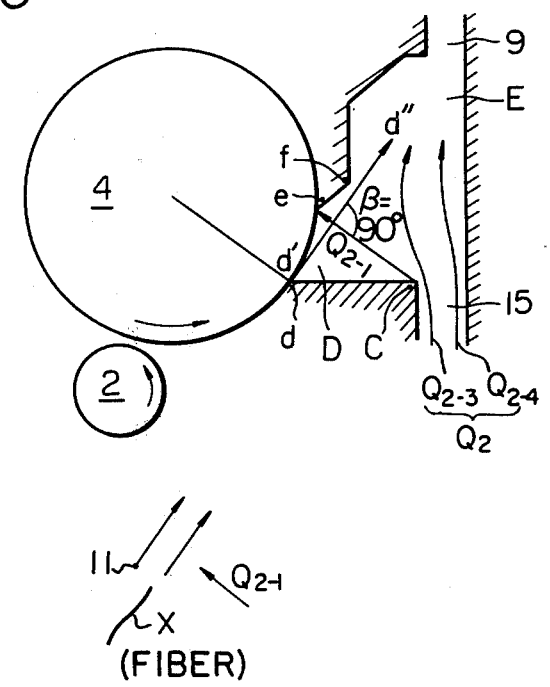
FIG. 6 is a view illustrating the arrangement in the apparatus of the present invention.

In the present invention, in order to separate as much as possible the main stream Q2-1 of the auxiliary air stream in the dust-separating zone D from the sucking air stream in the dust-discharging zone E, and thereby reduce the influence of the air stream Q2-3, a construction is provided whereby the extension of the line connecting the outer end c of the upstream wall 51 to the outer end f of the downstream wall 52 gradually becomes farther apart from the dust-discharging zone E. When this arrangement is adopted, as illustrated in FIG. 6, of the auxiliary air stream Q2 flowing in from the outer air intake opening, the main stream Q2-1 flows in a direction intersecting substantially at a right angle the flying direction of the flying material, and the air streams Q2-3 and Q2-4 directed to the suction opening flow in such a direction that for the most part they move away from the separating zone D. Accordingly, the main stream Q2-1 is not influenced by these streams Q2-3 and Q2-4 and it can perform assuredly a function most preferred for the dust removing apparatus. Namely, the main stream Q2-1 allows dust 11 to fly out but blocks the flying-off of fibers. By virtue of this specific function, in the apparatus of the present invention, there can be attained a feature that the removal ratio of dust is only slightly changed within arrange of $\beta 2=90\pm 10°$.

As will be apparent from the foregoing illustration, according to the dust removing mechanism of the above-mentioned embodiment of the present invention, since a fiber-blocking auxiliary air stream is caused to flow in a specific direction so as to effectively separate dust and fibers from each other in the separating zone and allow mainly the dust 11 to fly off, and since a dust-discharging sucking air stream is caused to flow in a direction for the most part away from the separating zone, no delicate adjustment of the intensity of the auxiliary air stream or dust-discharging sucking air stream is necessary. Accordingly, the intensity of the sucking air stream can be set at a level optimum for discharge of dust, and the intensity of the auxiliary air stream may be determined based on the so set intensity of the sucking air stream. Therefore, even if spinning conditions, such as the kind of the material fibers, are changed, the necessity of rearrangement of the intensity of the auxiliary air stream is very small. When fibers remain in the dust removing chamber they exert a role of catching other fibers and dust 11, and the remaining of fibers in the dust removing chamber results in formation of fiber masses and clogging of the suction opening. In the apparatus of the above-mentioned embodiment of the present invention, the auxiliary air stream acts very effectively on the fibers, and therefore, the mechanism is characterized in that an undesirable phenomenon of the remaining of fibers in the dust removing chamber is seldom caused to occur.

In this embodiment, the outside air intake opening 15 and the suction opening 9 are located on the same plane, but they may be located on different planes as long as they are communicated with each other. Further, additional outside air intake opening for discharge of dusts may be disposed independently from the outside air intake opening 15.

A second embodiment of the dust removing mechanism of the present invention will now be described in detail.

Figure 9:
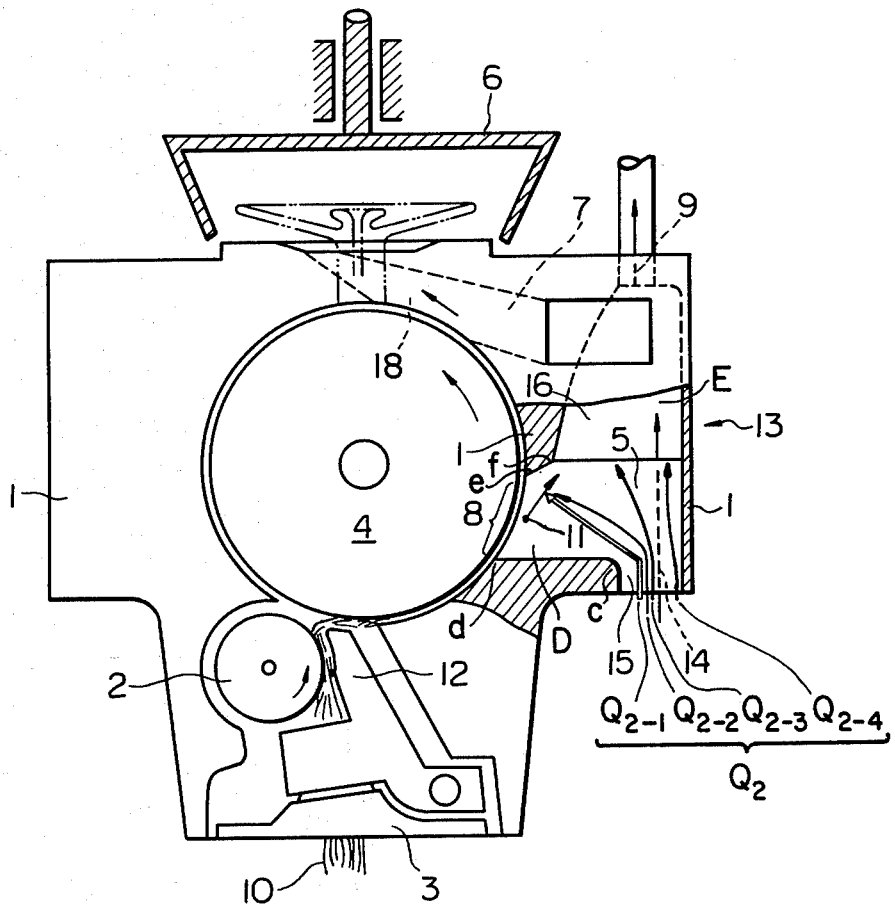

In an embodiment of the spinning unit shown in FIG. 9, a material sliver 10 fed through a collector 3 is gradually delivered into an adjacent opening zone including an opening roller 4 while being gripped between a presser 12 and a feed roller 2. The opening roller 4 is rotated at a high speed and it performs a fiber-opening action and a fiber-delivering action between an opening member attached to the peripheral surface thereof and the wall of a casing 1 surrounding the opening roller 4. Fibers delivered in the state of adhering to the peripheral surface of the opening roller 4 are peeled off by the difference of flow speeds of air streams in a fiber-peeling zone where the opening roller 4 becomes contiguous with a fiber-peeling channel 7 having one end communicated with the outside air and the other end directed to the interior of a rotary spinning chamber 6 constituting a twisting zone. The peeled fibers are delivered through the channel 7 into the rotary spinning chamber 6.

In the spinning unit having the above-mentioned structure, the mechanism of a second embodiment of the present invention is applied. The basic structure of the apparatus of the second embodiment comprises a dust-removing opening 8, formed on the casing 1 between the opening zone and fiber-peeling zone, and a dust removing zone 13 contiguous to the opening 8, including an outer intake opening 15 for an auxiliary air stream flowing in the opening 8, means for generating a sucking air stream for discharge of dust, namely a suction opening 9, and an outer air intake opening 14. In the dust removing method of the type including the dust removing opening 8 and means for generating a sucking air stream for discharge of dust, as pointed out hereinbefore, the design and air stream adjustment should be carried out while always taking into account the risk of staying dust, which comes from the dust removing opening, in the vicinity of the opening and the problem of the influence of the dust-discharging sucking air stream on the opening 8.

Figure 10:
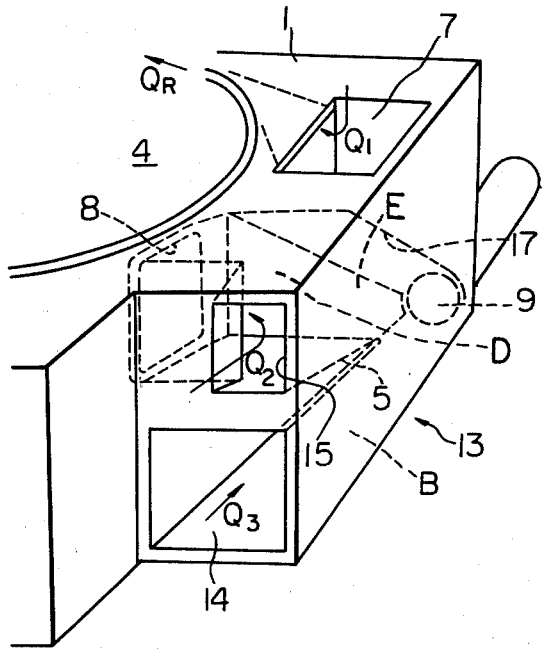
Figure 11:
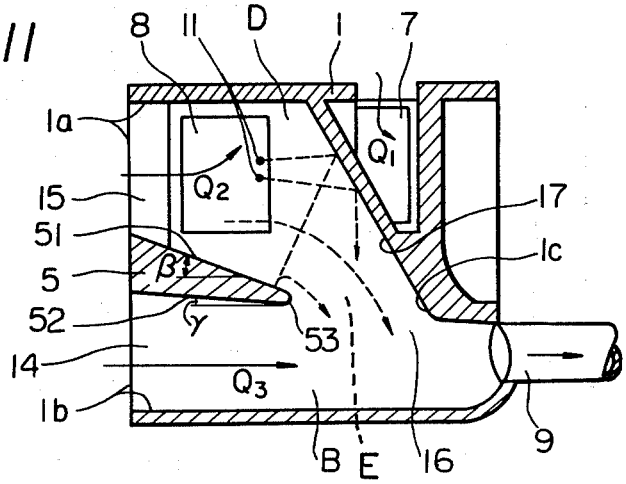
Figure 12:
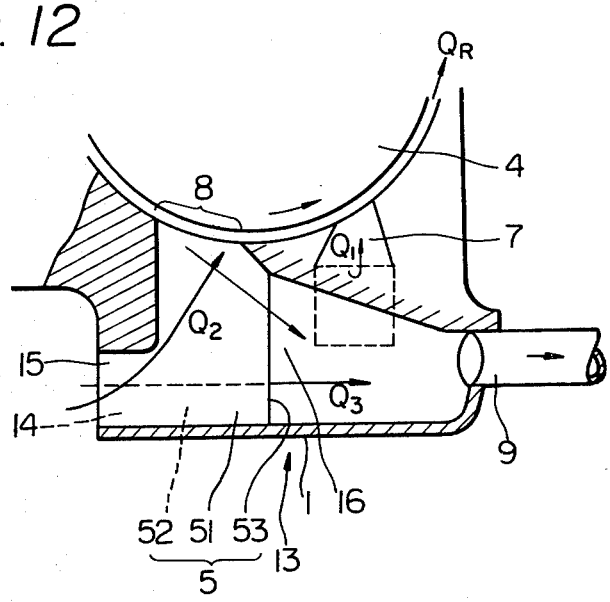

The second embodiment of the present invention is directed to eliminating the disadvantage of taking into account the above mentioned risk and problem. More specifically, referring to FIGS. 9 to 11, a separating plate 5 is disposed in the dust removing zone 13 to define a dust-separating zone D which allows flow-in of outer air and includes the opening 8, a dust-discharging zone E and a dust discharge-promoting zone B. In this second embodiment illustrated in FIGS. 9 to 11, the end portion of the upstream wall 51 of the separating plate 5, which defines the zones D and E, forms an outer air intake opening 15 with a casing wall 1*a*, and the end portion of the downstream wall 52 of the separating plate 5 which defines the zone B forms another outer air intake opening 14 with a casing wall 1*b*. Accordingly, the structure of the end portion of the face 51 of the separating plate 5 regulates the size of the outer air intake opening 15, so that it is capable of working as an element determining the intensity of an auxiliary air stream Q2 to the dust removing opening 8. Further, the structure of the end portion of the face 52 of the separating plate 5 regulates the size of the outer air intake opening 14 so that it is capable of working as an element determining the intensity of a sucking air stream Q3 in the zone B. This face 52 is directed to the suction opening 9 at an angle ($\gamma$) to the horizontal plane so that a linear air stream is generated in the zone B without residence of the sucking air stream in the zone B or formation of swirls in the zone B.

In this embodiment, a passage 16 communicating the zones D and E with the zone B is formed downstream of the dust removing opening 8 with respect to the rotation direction of the opening roller 4. The reason for provision of this communicating passage 16 is that dust 11 flying off from the opening 8 is caused to fly along the rotation direction of the opening roller 4 by the centrifugal action promoted by the rotation of the roller 4. In this embodiment the communicating passage 16 is formed between a top end 53 of the separating plate 5 and the casing end 1*c*.

In the above-mentioned second embodiment of the present invention, the casing wall on the downstream side of the dust-separating zone D and dust-discharging zone E is formed as an inclined wall 17 so that dust flying off from the dust removing opening 8 is allowed to bounce toward the communicating passage 16. The inclined wall 17 is disposed so that dust 11 flying off from the opening 8 is positively guided to the dust discharge-promoting zone B by utilizing the kinetic energy of the dust 11. Since this inclined wall 17 is formed so that the inclined wall 17 becomes close to the dust removing opening 8 as it becomes farther away from the communicating passage 16, the space of the portion which is only slightly influenced by the dust-discharging sucking air stream Q3 is diminished and the residence of the air stream or formation of eddy currents can be substantially prevented, and therefore, the causes of the accumulation of fibers in the opening and cleaning apparatus are eliminated and good results for separating dusts from the useful fibers can be created.

The operation of the mechanism of the second embodiment of the present invention having the above-mentioned structure will now be described in detail.

Fibers carried by the opening roller 4 have such tendency to fly off from the roller 4 by the centrifugal action when they arrive at the dust removing opening 8. However, an auxiliary air stream Q2 directed to the opening 8 is generated by negative pressure in the rotary spinning chamber 6 and the air-sucking action owing to the rotation of the opening roller 4, and this air stream Q2 flows in from the outer air intake opening 15. This air stream Q2 has a considerable intensity and it acts in a direction substantially at a right angle to the locus of the dust 11 and fibers flying in the tangential direction of the opening roller 4. Accordingly, the free motion of the dust 11 having a larger mass than the fibers overcomes the force of the auxiliary air stream Q2 and the dust flies into the dust-separating zone, but the free motion of the fibers having a smaller mass than the dust is blocked by the force of the auxiliary air stream Q2 and delivery of the fibers by the opening roller 4 is continued.

Parts of the dust 11 overcoming the auxiliary air stream Q2 is reduced speed thereof and arrive directly at the communicating passage 16, and then, they are discharged while being carried by the sucking air stream Q3 flowing in the dust-discharging zone B. However, the majority of the dust is caused to impinge against and bounce from the inclined wall 17 by the large kinetic energy of the dust and the majority of the bouncing dust comes under the influence of the air stream Q3 through the communicating passage 16, while the remaining parts of the bouncing dust are caused to impinge against and bounce from the face 51 of the separating plate 5, and they are reduced their speeds and are introduced into the communicating passage 16. In order to prevent the bouncing dust from intruding again into the dust removing opening 8 due to the influence of the auxiliary air stream Q2, it is preferred that the face 51 be an inclined face convergent with the communicating passage 16 [inclined at an angle ($\beta$) to the horizontal plane].

The relation among air streams will now be described.

The sucking air stream Q3 in the dust discharge-promoting zone B has no substantial influence on the dust removing opening 8, because of the presence of the separating plate 5, even if the intensity of the air stream Q3 is considerably high. Particularly, since the face 52 of the separating plate 5 promotes generation of a linear air stream to the suction opening 9, introduction of the air stream from the dust-separating zone D and dust-discharging zone E through the communicating passage 16 is remarkably reduced. Accordingly, the flow-in air stream from the communication passage 16 has no substantial influence on the auxiliary air stream Q2. More specifically, an air stream QR has a very high intensity, because of the negative pressure in the rotary spinning chamber 6 and rotation of the opening roller 4. This air stream QR is divided between the auxiliary air stream Q2 and the flow-in air stream Q1 from the fiber-peeling channel 7, but the intensity of the auxiliary air stream Q2 is still much higher than the intensity of the above-mentioned air stream flowing in the zone B from the communicating passage 16. This weak air stream flowing in the zone B from the communicating passage 16 is rather preferred. Namely, the dust which flies off from the dust removing opening 8, and is reduced speed thereof and tend to stay in the vicinity of the opening 8 without flying to the communicating passage 16, can be drawn up to the dust discharge-promoting zone B by the action of this weak air stream.

As will be apparent from the foregoing illustration, in the present embodiment, by the actions of the inclined wall 17 and separating plate 5, the dust 11 flying off from the dust removing opening 8 is not allowed to stay in either the dust-separating zone D or dust-discharging zone E, and the dust 11 is completely introduced into the dust discharge-promoting zone B. Also in this zone B, by the action of the linear air stream Q3, the dust 11 is not allowed to stay in the zone B, and it is discharged from the suction opening 9 to the dust-collecting zone (not shown).

In the present embodiment, the existence of the separating plate 5, which separates the dust removing zone 13 into the dust-separating zone D, the dust-discharging zone E and the dust discharge-promoting zone B, is very significant, as will readily be understood from the foregoing illustration. The top end 53 of the separating plate 5 is extended in the downstream direction, with respect to the rotation direction of the opening roller 4, whereby the dust removing opening 8 is substantially isolated from the sucking air stream Q3 in the zone B. Further, this separating plate 5 forms, together with the inclined wall 17, the communicating passage 16 leading to the zone B. Moreover, the face 51 of the separating plate 5 in the zones D and E acts co-operatively with the inclined wall 17 to introduce the dust to the communicating passage 16, and the face 52 of the separating plate 5 in the zone B is very effective for forming a linear flow passage for the sucking air stream Q3. As a result, the quantity of the flow-in air stream from the zones D and E can be reduced to a lowest level and the influence of such flow-in air stream on the auxiliary air stream Q2 to the dust removing opening 8 can be completely eliminated.

In the present embodiment, by virtue of provision of the separating plate 5 having the above-mentioned desirable functions, the dust-separating zone D and dust-discharging zone E can be disposed very contiguously to the dust discharge-promoting zone B, and hence, the dust removing zone 13 can be made very compact and the space can be utilized very effectively. Further, it is possible to generate air streams capable of performing the respective functions in the zones D, E and B, respectively. Consequently, according to the present embodiment, there can be provided a very effective and satisfactory dust removing mechanism.

Figure 13:
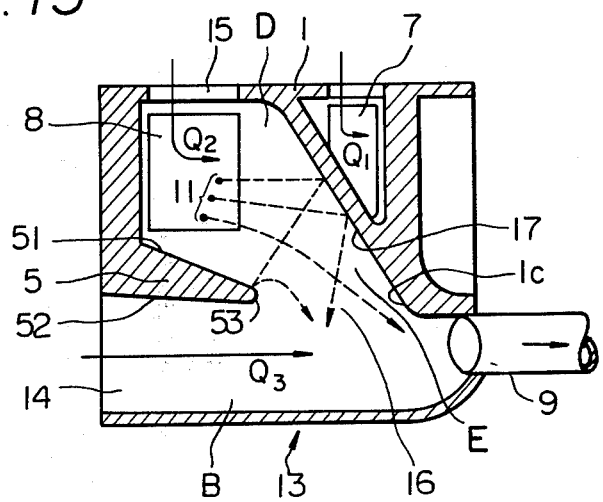
Figure 14:
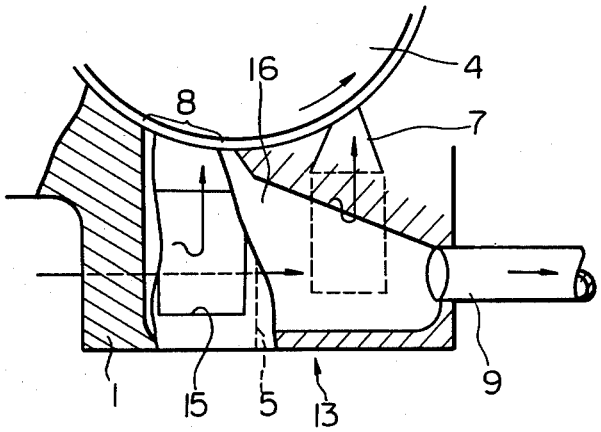

In a third embodiment illustrated in FIGS. 13 and 14, an arrangement is provided so that an auxiliary air stream Q2, which is introduced into dust removing opening 8, is formed by an air stream which is introduced from an outer air intake opening 15 formed on the casing face perpendicular to the rotation axis of the opening roller 4. Other structural features and functions of the third embodiment are identical to those of the second embodiment illustrated in FIGS. 9, 10, 11 and 12.

Figure 15:
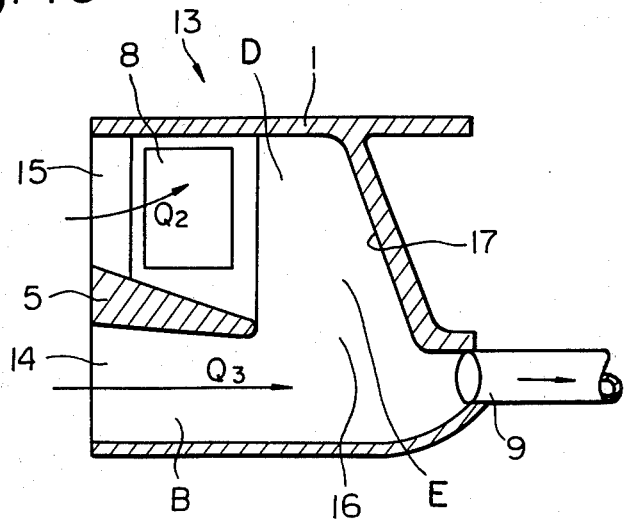
FIG. 15 is a sectional side view illustrating a fourth embodiment of the apparatus of the present invention.

In a fourth embodiment illustrated in FIG. 15, in order to establish the relation of QR=Q2, the fiber-peeling channel 7 connected to a fiber transfer channel is not provided and the air stream Q1 in this channel 7 is allowed to flow-in from the dust removing opening 8. Further, the separating plate 5 may be located on the side faces of the dust-separating zone and dust-discharging zones so that the dust discharge-promoting zone is located contiguously to the side faces of the separating and discharging zones, though this modification is not specifically illustrated in the drawings.

What we claim is:

1. In an open-end spinning unit provided with an opening roller and a casing partly surrounding said opening roller, a dust removing opening formed on said casing and a dust removing zone communicated with said dust removing opening, a dust removing mechanism applied for said spinning unit, comprising a pair of upstream and downstream walls located at the respective positions extended from the upstream and downstream terminals of said dust removing opening, respectively, in connection with the rotational direction of said opening roller, so that a dust-separation zone is formed in said dust-removing zone by said upstream and downstream walls, a dust-discharging zone communicated with said dust-separation zone, an outer air intake opening formed at an external position of an outer end of said upstream wall, a dust-discharging suction opening formed at a position downstream of said intake opening with respect to the rotation direction of said opening roller, a first imaginary plane passing said outer end of said upstream wall and an inner end of said downstream wall being set so that said first imaginary plane intersects substantially perpendicularly an imaginary plane which is tangential to the peripheral surface of said opening roller at a position facing an inner end of said upstream wall, a second imaginary plane including said outer end of said upstream wall and an outer end of said downstream wall being set so that second imaginary plane gradually becomes separated from said dust-discharging zone.

2. A dust removing mechanism according to claim 1, further comprising a separating plate disposed in said dust removing zone, a dust discharge promoting zone formed at a position contiguous to said dust-separating zone and said dust-discharging zone by way of said separating plate, said dust discharge promoting zone communicated with the atmosphere, a passage for communicating said discharging zone with said dust discharge-promoting zone formed at a position downstream of said dust removing opening with respect to the rotational direction of said opening roller.

3. A dust removing mechanism according to claim 2, wherein said casing is provided with an inclined wall at a position on the downstream side of said dust-separating zone, whereby dust flying off from said dust removing opening is caused to impinge against said inclined wall and bounce into said communicating passage.

4. A dust removing mechanism according to claim 2, wherein said casing is provided with an inclined wall at a position on the downstream side of said dust discharging zone, whereby dust flying off from said dust removing opening is caused to impinge against said inclined wall and bounce into said communicating passage.

5. A dust removing mechanism according to claim 2, wherein said dust discharging-promoting zone is formed at a position below said dust-separating zone and dust-discharging zone contiguous thereto through said separating plate.

6. A dust removing mechanism according to claim 2, wherein said dust discharge-promoting zone is formed in the sideway of said dust-separating zone and dust-discharging zone contiguous thereto through said separating plate.

7. A dust removing mechanism according to claim 1, wherein the intersecting angle between said first imaginary plane and said tangential plane is in a range of from about 80° to about 100°.

8. In an open-end spinning unit provided with an opening roller, a rotary spinning chamber for creating a yarn from fibers received from said opening roller, a casing partly surrounding said opening roller, a dust removing opening formed on said casing and a dust removing zone communicated with said dust removing opening, a dust removing mechanism applied for said spinning unit, comprising a separating plate disposed in said dust removing zone, said dust removing zone being divided into a dust separating zone, a dust-discharging zone and a dust discharge promoting zone by said separating plate, said dust separating zone communicated with said dust removing opening and being capable of allowing flow-in of an auxiliary air stream, said dust dicharge-promoting zone communicated with the atmosphere in a condition capable of creating a linear sucking air stream thereinto, said dust-discharge promoting zone communicated with said dust-separating zone and said dust discharging zone by way of a communicating passage at a position downstream of said dust removing opening with respect to the rotation direction of said opening roller.

9. A dust removing mechanism according to claim 8, wherein said casing is provided with an incline wall at a position downstream of said dust-separating zone, whereby dust flying-off from said dust removing opening is caused to impinge against said inclined wall and bounce into said communicating passage.

10. A dust removing mechanism according to claim 8, wherein said casing is provided with an inclined wall at a position downstream of said dust-discharging zone, whereby dust flying-off from said dust removing opening is caused to impinge against said inclined wall and bounce into said communicating passage.

11. A dust removing mechanism according to claim 8, wherein said dust separation zone is defined by a pair of upstream and downstream walls located at the respective positions extended from the upstream and downstream terminals of said dust removing opening, respectively, in connection with the rotational direction of said opening roller, an outer air intake opening formed at an external position of an outer end of said upstream wall, whereby a sucking air stream into said rotary spinning chamber is sucked through said intake air opening for taking in outside air as an auxiliary air stream by which the separation of dust from the useful fibers is effectively carried out.

12. A dust removing mechanism according to claim 11, wherein said intake opening is also communicated with said spinning chamber by a passage surrounding said opening roller, and thereby peeling action of fibers from said opening roller is effectively carried out.

13. A dust removing mechanism according to claim 8, further comprising an opening for taking in outside air arranged at a position above said dust-separating zone so that the separation of dust from the useful fibers is effectively carried out by an auxiliary air stream created by the taking in of air from the outside.

* * * * *